US007127969B2

(12) United States Patent
Hsieh

(10) Patent No.: US 7,127,969 B2
(45) Date of Patent: Oct. 31, 2006

(54) ANTI-ROLLING SOCKET

(76) Inventor: Chih-Ching Hsieh, No. 367, Pei Yang Road, Feng Yuan City, Taichung Hsien (TW)

( * ) Notice: Subject to any disclaimer, the term of this patent is extended or adjusted under 35 U.S.C. 154(b) by 23 days.

(21) Appl. No.: 10/956,052

(22) Filed: Oct. 4, 2004

(65) Prior Publication Data

US 2006/0000318 A1 Jan. 5, 2006

(30) Foreign Application Priority Data

Jun. 30, 2004 (TW) ..... 93119644 A

(51) Int. Cl.
*B25B 13/06* (2006.01)
*B25B 13/02* (2006.01)

(52) U.S. Cl. ..... 81/121.1; 81/120; 81/124.3

(58) Field of Classification Search ..... 81/121.1, 81/120, 124.3; D8/21–29, 124.4; 285/331
See application file for complete search history.

(56) References Cited

U.S. PATENT DOCUMENTS 108,143 A * 10/1870 Mandl ..... 16/277
838,109 A * 12/1906 Hanes ..... 81/61
5,048,379 A * 9/1991 Gramera et al. ..... 81/124.4
D437,537 S * 2/2001 Carter, Jr. ..... D8/29
6,282,994 B1 * 9/2001 Wei ..... 81/121.1
6,726,393 B1 * 4/2004 Tsai et al. ..... 403/109.4
6,951,156 B1 * 10/2005 Garg ..... 81/121.1
2003/0126960 A1 * 7/2003 Chen ..... 81/121.1
2004/0074344 A1 * 4/2004 Carroll ..... 81/121.1

* cited by examiner

*Primary Examiner*—Lee D. Wilson
*Assistant Examiner*—Alvin J. Grant
(74) *Attorney, Agent, or Firm*—Troxell Law Office, PLLC

(57) ABSTRACT

An anti-rolling socket. One end of the socket is formed with a fitting hole for fitting on a threaded member. An annular rib with a certain angle of arch is formed on a circumference of the socket to form a maximum outer diameter of the socket. A distance from a first end of the socket to the rib is longer than a distance from a second end of the socket to the rib. In the case that the annular rib has a 360 degree arch, when the socket is placed on a plane, the annular rib and the first end of the socket contact with the plane. When the socket rolls, the socket rolls about a circle. In the case that the annular rib has an arch that the angle of which is less than 360 degrees, when the socket rolls, the socket can only roll within a range less than one circle.

10 Claims, 5 Drawing Sheets

ANTI-ROLLING SOCKET

FIELD OF THE INVENTION

The present invention is related to an accessory of a hand tool, and more particularly to a socket. When placed on a plane, the socket will not roll too far.

BACKGROUND OF THE INVENTION

FIGS. 1A and 1B respectively show two types of conventional sockets 10 and 12. The first type of socket 10 has a large diameter end 14 and a small diameter end 16. The second type of socket 12 has a unified outer diameter. Both the sockets have a cylindrical shape. When placing the socket on a ground, the socket tends to roll on the ground. (With respect to the socket 10, the heavier large diameter end 14 will roll on the ground, while the small diameter end 16 will not contact the ground. ) The cylindrical socket tends to linearly roll randomly, especially in the case that the ground is inclined or a worker kicks the socket. It often takes place that the socket rolls into a hidden corner or under a machine bed and is hard to recover. Especially in a large-size working site such as a repair work, the socket often rolls away unexpectedly and is lost. It leads to inconvenience in working.

SUMMARY OF THE INVENTION

It is therefore a primary object of the present invention to provide an anti-rolling socket which can only roll within a small range without rolling to a remote place.

According to the above object, an annular rib is formed on the circumference of the socket. The annular rib has an outer diameter larger than the diameter of the socket. By means of the annular rib, the socket can only roll within a small range.

The present invention can be best understood through the following description and accompanying drawings wherein:

DETAILED DESCRIPTION OF THE PREFERRED EMBODIMENTS

Figure 1A:
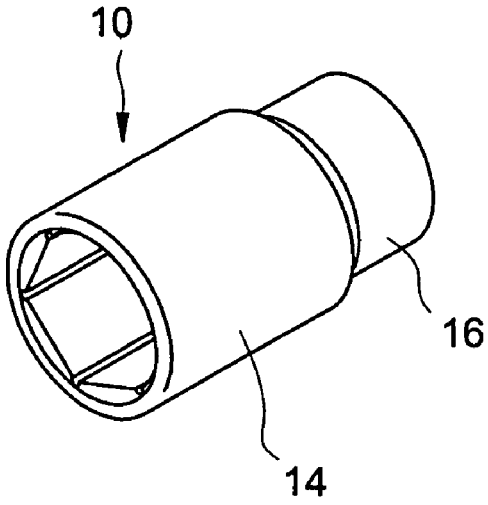
Fig. 1A PRIOR ART
FIG. 1A is a perspective view of a conventional socket.
Figure 1B:
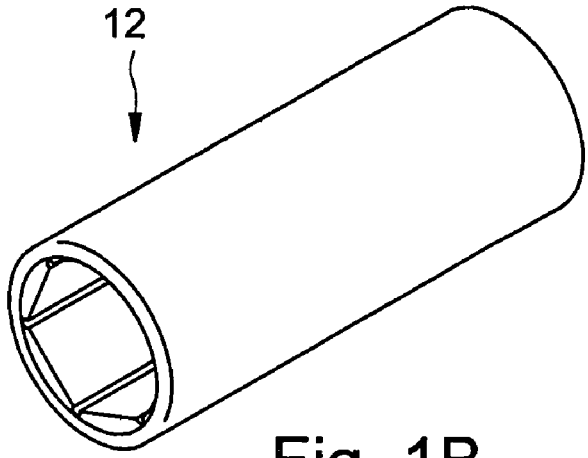
Fig. 1B PRIOR ART
FIG. 1B is a perspective view of another conventional socket.
Figure 2:
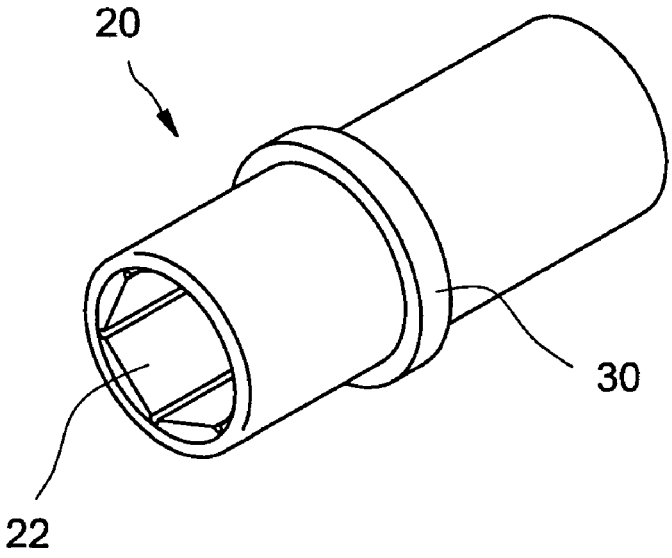
FIG. 2 is a perspective view of a preferred embodiment of the present invention.

Please refer to FIG. 2. According to a first embodiment, the socket 20 of the present invention is a cylindrical socket with unified diameter.

One end of the socket 20 is formed with a hexagonal or dodecagonal fitting hole 22 for fitting on a nut or a bolt. The other end of the socket is a driving end formed with a quadrangular hole (not shown) in which a handle of a wrench can be inserted for driving the socket.

The socket 20 further comprises an annular rib 30 formed on a circumference of the socket. The outer diameter of the annular rib 30 is larger than the diameter of the socket so that the annular rib 30 forms a maximum outer diameter of the socket. The annular rib 30 can be made by milling or forging. In this embodiment, the annular rib has a 360-degree arch.

Figure 3:
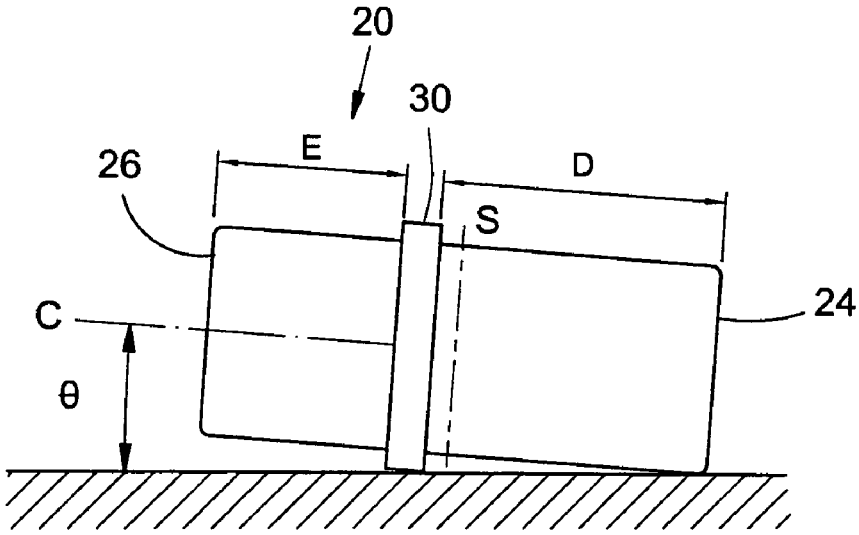
FIG. 3 shows that the socket of the present invention is placed on a plane.

Please refer to FIG. 3. The annular rib 30 is not located at the center S of the socket 20, so that the distance D from a first end 24 of the socket to the rib 30 is longer than the distance E from a second end 26 of the socket to the rib 30.

Figure 4:
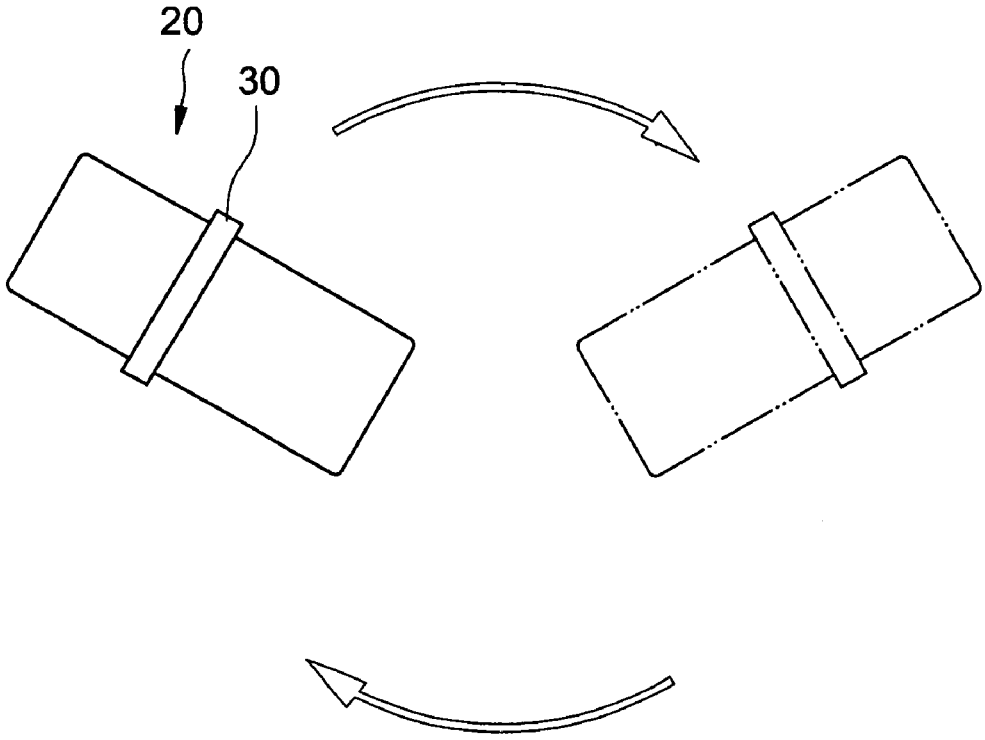
FIG. 4 shows that the socket of the present invention rolls on the plane.

As shown in FIG. 3, when placing the socket 20 on a plane such as the ground, the annular rib 30 and the first end 24 of the socket contact with the ground. Therefore, the axis C of the socket and the ground contain an angle θ. Accordingly, as shown in FIG. 4, when the socket rolls, the socket will roll about a circle within a small range without rolling to a remote place.

The annular rib 30 can have a straight cylindrical shape or conic shape. In the case that the annular rib is conic, the outer circumference of the annular rib will attach to the ground.

Figure 5:
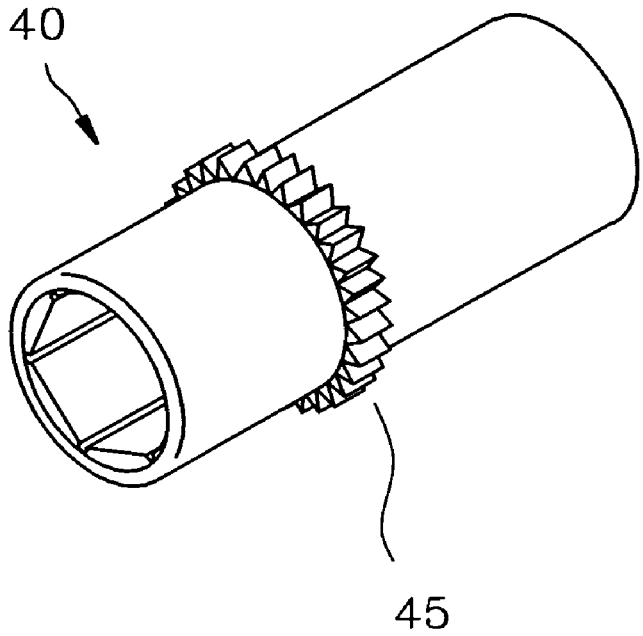
FIG. 5 is a perspective view of another embodiment of the present invention.

FIG. 5 shows another embodiment of the present invention, in which the annular rib 45 of the socket is made with coarse teeth by rolling.

Figure 6:
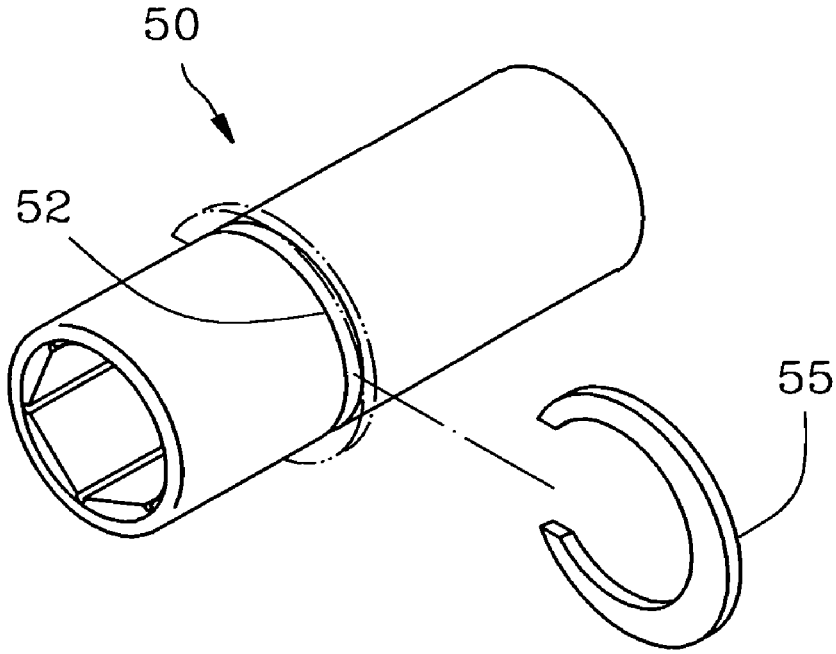
FIG. 6 is a perspective exploded view of still another embodiment of the present invention.

FIG. 6 shows still another embodiment of the present invention, in which the circumference of the socket 50 is formed with an annular groove 52 in which a C-shaped retainer ring 55 is retained. The C-shaped retainer ring 55 forms an annular rib on the circumference of the socket as shown by phantom line. Similarly, the annular rib forms a maximum outer diameter of the socket 50.

Figure 7:
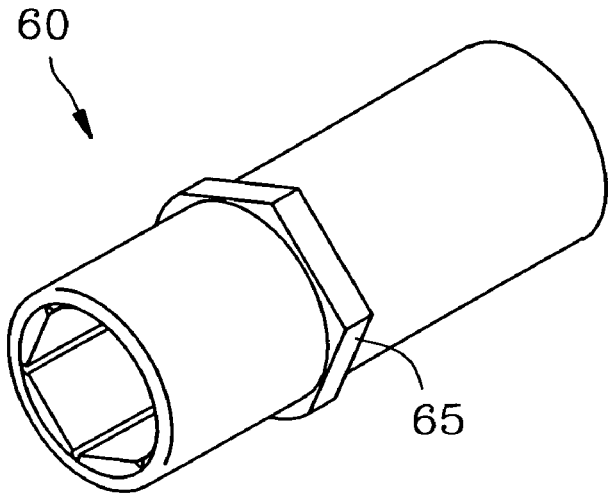
FIG. 7 is a perspective view of still another embodiment of the present invention.

FIG. 7 shows still another embodiment of the socket of the present invention, in which the annular rib 65 formed on the circumference of the socket 60 is polygonal such as pentagonal, hexagonal and octagonal. By means of the polygonal annular rib 65, the socket 60 can only roll about a circle. Moreover, the polygonal annular rib 65 serves to reduce the rollability of the socket.

Figure 8:
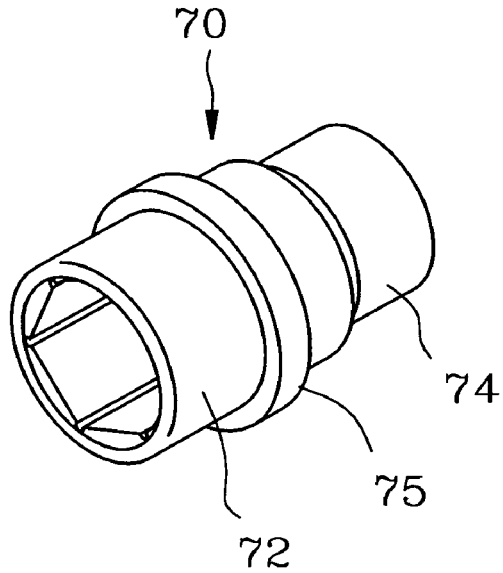
FIG. 8 is a perspective view of still another embodiment of the present invention.

FIG. 8 shows still another embodiment of the present invention, in which the socket 70 has a large diameter end 72 and a small diameter end 74. The aforementioned annular rib 30, 45, 55 or 65 can be alternatively formed on the circumference of such socket. FIG. 8 shows that a straight cylindrical annular rib 75 is formed on the socket. The annular rib 75 can be formed on the circumference of the large diameter end 72 or the small diameter end 74. In both cases, the annular rib forms a maximum outer diameter of the socket, whereby the socket can only roll about a circle.

Figure 9:
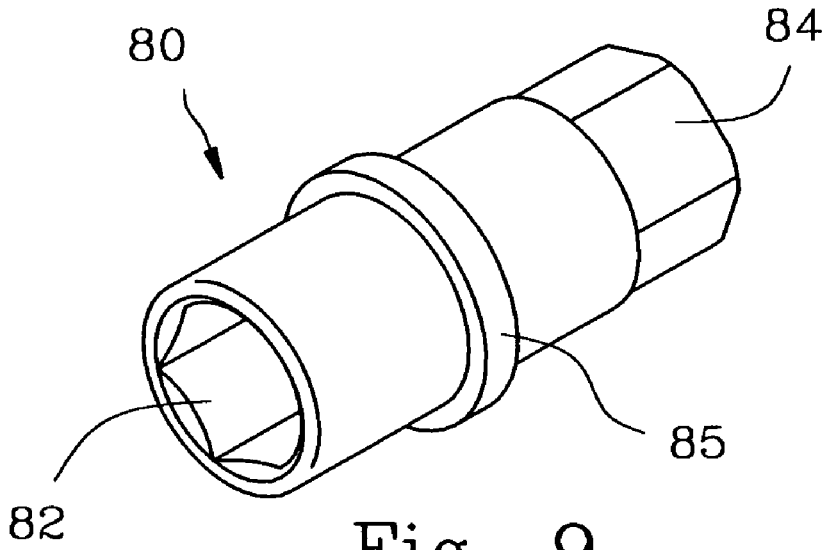
FIG. 9 is a perspective view of still another embodiment of the present invention.

FIG. 9 shows still another embodiment of the present invention, in which one end of the socket 80 is formed with a fitting hole 82, while the other end of the socket is a hexagonal driving end for fitting with a handle of a wrench. Similarly, an annular rib 85 is formed on the circumference of the socket to form a maximum outer diameter of the socket.

The arch of the annular rib of the present invention is not limited to 360 degrees. Alternatively, the annular rib can be an arch less than 360 degrees. For example, the annular rib can be a 90-degree, 180-degree or 270-degree arch.

Figure 10:
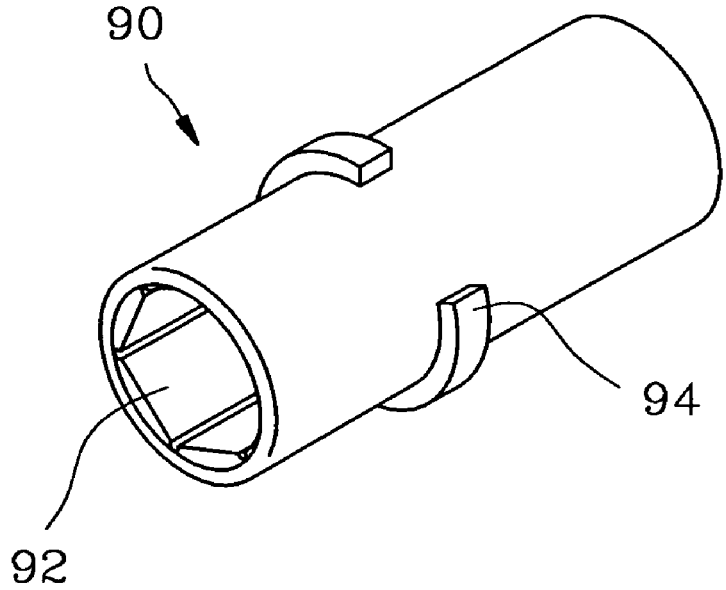
FIG. 10 is a perspective view of still another embodiment of the present invention.

FIG. 10 shows still another embodiment of the present invention, in which the annular rib 94 formed on the socket 90 is an arch less than 360 degrees. A drop exists between the circumference of the socket and the annular rib. Due to the drop, when the socket rolls, the socket can only roll within a sector range less than one circle.

The above embodiments are only used to illustrate the present invention, and are not intended to limit the scope thereof. Many modifications of the above embodiments can be made without departing from the spirit of the present invention.

What is claimed is:

1. An anti-rolling socket comprising:

a socket body having:

a) a first end having a fitting hole;

b) a second end being a driving end;

c) a center located a length thereof between the first end and the second end; and d) a supporting device having a supporting device diameter larger than a diameter of the first end and larger than a diameter of the second end, the supporting device being spaced apart a predetermined distance from the center and axially fixed to the socket body.

2. The anti-rolling socket according to claim 1, wherein the supporting device is an annular rib having a cylindrical shape.

3. The anti-rolling socket according to claim 1, wherein the supporting device is an annular rib having a conical shape.

4. The anti-rolling socket according to claim 1, wherein the supporting device is an annular rib having a polygonal shape.

5. The anti-rolling socket according to claim 1, wherein the supporting device is an annular rib having a C-shape.

6. The anti-rolling socket according to claim 1, wherein the supporting device has a plurality of teeth protruding outwardly from an outer periphery thereof.

7. The anti-rolling socket according to claim 1, wherein the supporting device extends around a predetermined portion of an exterior of the socket body, the predetermined portion is in a range between 1 degree and 360 degrees.

8. The anti-rolling socket according to claim 1, wherein the supporting device is a retaining ring having a C-shape, the socket body having an annular groove, the retaining ring is inserted into the annular groove.

9. The anti-rolling socket according to claim 1, wherein the diameter of the first end is larger than the diameter of the second end.

10. The anti-rolling socket according to claim 1, wherein the diameter of the second end is larger than the diameter of the first end.

* * * * *